US011201418B2

(12) United States Patent
Stokoe

(10) Patent No.: US 11,201,418 B2
(45) **Date of Patent: *Dec. 14, 2021**

(54) MULTI-STAGE BEAM CONTACTS

(71) Applicant: Amphenol Corporation, Wallingford, CT (US)

(72) Inventor: Philip T. Stokoe, Attleboro, MA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,507

(22) Filed: Aug. 11, 2020

(65) Prior Publication Data

US 2020/0373690 A1 Nov. 26, 2020

Related U.S. Application Data

(63) Continuation of application No. 16/355,378, filed on Mar. 15, 2019, now Pat. No. 10,741,940, which is a (Continued)

(51) Int. Cl.
*H01R 12/51* (2011.01)
*H01R 13/193* (2006.01)
(Continued)

(52) U.S. Cl.
CPC ..... *H01R 12/51* (2013.01); *H01R 13/193* (2013.01); *H01R 13/28* (2013.01); *H01R 13/6473* (2013.01)

(58) Field of Classification Search
CPC ..... H01R 12/51; H01R 12/50; H01R 13/193; H01R 13/02; H01R 13/28; H01R 13/26;
(Continued)

(56) References Cited

U.S. PATENT DOCUMENTS 4,288,139 A 9/1981 Cobaugh
4,740,180 A * 4/1988 Harwath ..... H01R 13/193 439/848

(Continued)

FOREIGN PATENT DOCUMENTS

CN 1094859 A 11/1994
EP 0801821 A 10/1997

OTHER PUBLICATIONS

Office Action for CN 201610887169.2 dated Nov. 5, 2019, 8 pgs.

*Primary Examiner* — Harshad C Patel
(74) *Attorney, Agent, or Firm* — Blank Rome LLP

(57) ABSTRACT

An electrical connector has a first wafer having a first housing with a first plurality of contact beams extending from the first housing in a first plane. A second wafer has a second housing with a second plurality of contact beams extending from said second housing in a second plane substantially parallel to the first plane. A dividing panel member extends from the insulative housing between the first plurality of contact beams and the second plurality of contact beams. Each of the contact beams extending from the wafer pair is configured to mate with a corresponding backplane contact in a backplane connector. The contact beams extending from the wafer pair and the backplane contacts are configured such that each pair of corresponding contacts includes a first contact point and a second contact point. When the wafer pair is fully received by the backplane connector, contact between the contact beam and the backplane contact is maintained at both the first and second contact points. Each of the contact beams includes a pivot member configured such that the electrical connector has a low initial insertion force, but a high normal force when fully mated with the backplane connector.

16 Claims, 9 Drawing Sheets

Related U.S. Application Data continuation of application No. 13/958,029, filed on Aug. 2, 2013, now Pat. No. 10,243,284, which is a continuation-in-part of application No. 13/214,851, filed on Aug. 22, 2011, now Pat. No. 8,512,081.

(60) Provisional application No. 61/437,746, filed on Jan. 31, 2011.

(51) Int. Cl.
*H01R 13/28* (2006.01)
*H01R 13/6473* (2011.01)

(58) Field of Classification Search
CPC .... H01R 13/04; H01R 13/00; H01R 13/6473; H01R 13/646
USPC ..... 439/660, 626, 79, 500, 76.1, 78, 108, 439/943, 630, 267, 947, 65
See application file for complete search history.

(56) References Cited

U.S. PATENT DOCUMENTS 4,859,199 A 8/1989 Komatsu
5,266,046 A 11/1993 Bogiel
5,290,181 A * 3/1994 Bixler ..... H01R 13/193 439/692
5,295,843 A * 3/1994 Davis ..... H01R 13/658 439/108
5,713,746 A 2/1998 Olson et al.
5,785,557 A 7/1998 Davis
5,971,785 A 10/1999 Comerci
6,102,723 A 8/2000 Kusakabe et al.
6,244,887 B1 6/2001 Commerci et al.
6,506,076 B2 1/2003 Cohen et al.
6,530,790 B1 3/2003 McNamara et al.
6,846,202 B1 * 1/2005 Schmidt ..... H01R 13/26 439/247
6,872,085 B1 3/2005 Cohen et al.
7,163,421 B1 1/2007 Cohen et al.
7,182,642 B2 2/2007 Nqo
7,267,515 B2 9/2007 Lappohn
7,476,108 B2 1/2009 Swain
7,722,401 B2 5/2010 Kirk et al.
7,794,240 B2 9/2010 Cohen et al.
7,794,278 B2 9/2010 Cohen et al.
8,512,081 B2 * 8/2013 Stokoe ..... H01R 13/62 439/660
10,243,284 B2 * 3/2019 Stokoe ..... H01R 13/193
10,741,940 B2 * 8/2020 Stokoe ..... H01R 12/51
2002/0013101 A1 1/2002 Long
2002/0106930 A1 8/2002 Pape
2003/0219999 A1 11/2003 Minich
2009/0221165 A1 * 9/2009 Buck ..... H01R 13/514 439/108
2010/0093209 A1 4/2010 Liu
2010/0216347 A1 * 8/2010 Mizukami ..... H01R 12/724 439/660
2010/0291803 A1 11/2010 Kirk

* cited by examiner

FIG. 2
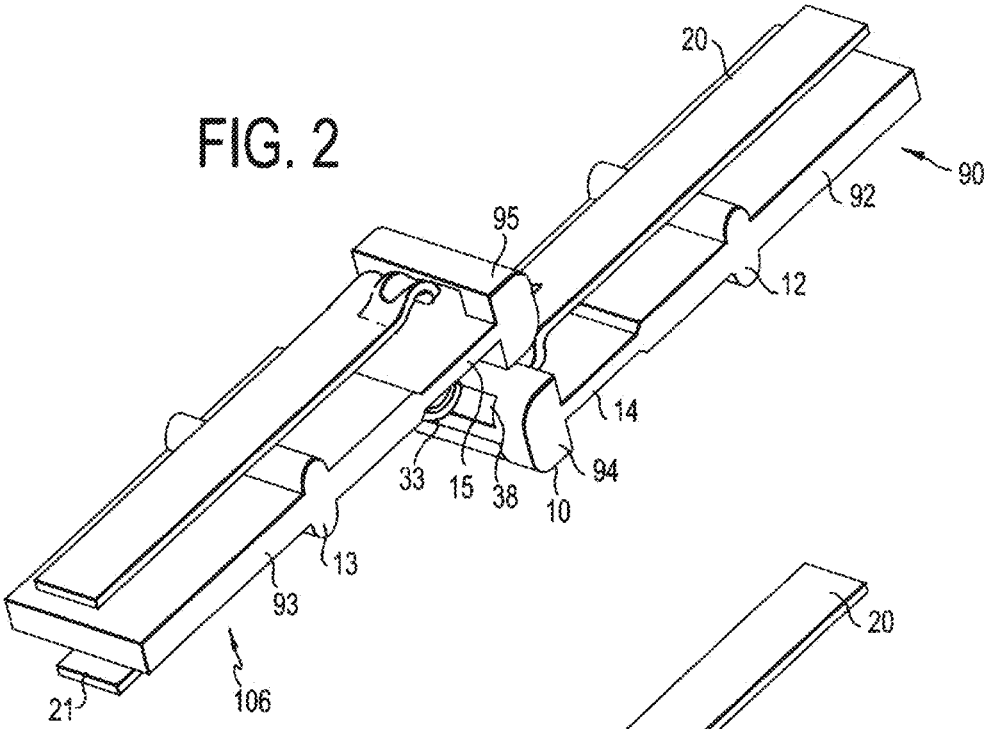
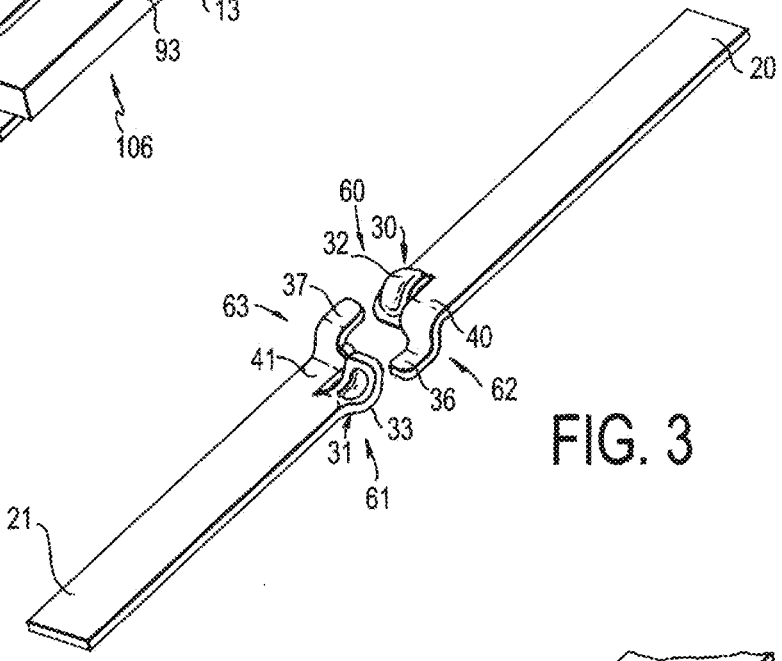
FIG. 3
FIG. 4
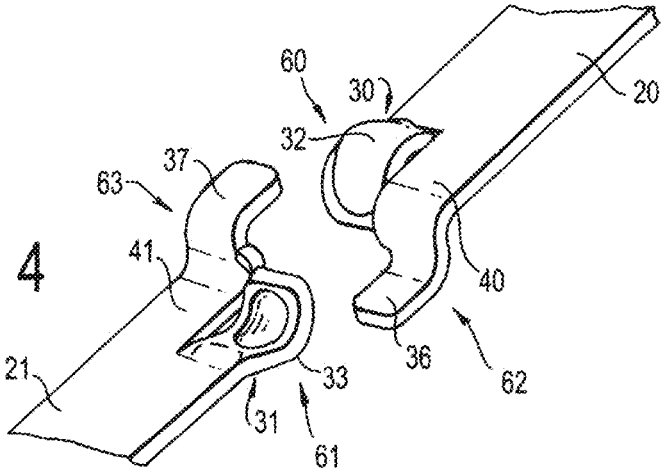

MULTI-STAGE BEAM CONTACTS

CROSS REFERENCE TO RELATED APPLICATIONS

This application is a continuation U.S. application Ser. No. 16/355,378 filed Mar. 15, 2019, now U.S. Pat. No. 10,741,940, issued Aug. 11, 2020, which is a continuation of U.S. application Ser. No. 13/958,029 filed Aug. 2, 2013, now U.S. Pat. No. 10,243,284, which is a continuation-in-part of U.S. Pat. No. 8,512,081, filed Aug. 22, 2011, which claims the benefit of U.S. Prov. App. No. 61/437,746, filed Jan. 31, 2011. The entire contents of all of which are incorporated herein by reference.

BACKGROUND OF THE INVENTION

Field of the Invention

The present invention relates to multi-stage connectors. More particularly, the present invention provides mating contacts that maintain reliable contact with one another to improve electrical performance and reduce the possibility of stubbing.

Background of the Related Art

Electrical connectors are used in many electronic systems. It is commonplace in the industry to manufacture a system on several printed circuit boards ("PCBs") which are then connected to one another by electrical connectors. A traditional arrangement for connecting several PCBs is to have one PCB serve as a backplane. Other PCBs, which are called daughterboards or daughtercards, are then connected to the backplane by electrical connectors.

Electronic systems have generally become smaller, faster, and functionally more complex. These changes mean that the number of circuits in a given area of an electronic system, along with the frequencies at which the circuits operate, continues to increase. Current systems pass more data between printed circuit boards and require electrical connectors that are capable of handling the increased bandwidth.

As signal frequencies increase, there is a greater possibility of electrical noise, such as reflections, cross-talk, and electromagnetic radiation, being generated in the connector. Therefore, electrical connectors are designed to control cross-talk between different signal paths and to control the characteristic impedance of each signal path.

Electrical connectors have been designed for single-ended signals as well as for differential signals. A single-ended signal is carried on a single signal conducting path, with the voltage relative to a common reference conductor representing the signal. Differential signals are signals represented by a pair of conducting paths, called a "differential pair." The voltage difference between the conductive paths represents the signal. In general, the two conducting paths of a differential pair are arranged to run near each other. No shielding is desired between the conducting paths of the pair but shielding may be used between differential pairs.

U.S. Pat. No. 7,794,240 to Cohen et al., U.S. Pat. No. 7,722,401 to Kirk et al., U.S. Pat. No. 7,163,421 to Cohen et al., and U.S. Pat. No. 6,872,085 to Cohen et al., are examples of high density, high speed differential electrical connectors. Those patents provide a daughtercard connector having multiple wafers with signal and ground conductors. The wafer conductors have contact tails at one end which mate to a daughtercard, and mating contacts at an opposite end which mate with contact blades in a shroud. The contact blades, in turn, have contact tails which mount to connections in a backplane.

The connection between the mating contacts of the wafer and the contact blades of the shroud generally require a minimum contact swipe of 2.0 mm to 3.0 mm. That distance primarily accommodates system tolerances associated with design, manufacture and assembly. At 20-30 GHz, the traditional 2.0 mm to 3.0 mm contact over-travel in present contact systems creates an antenna/stub that resonates, negatively impacting the signal capability.

SUMMARY OF THE INVENTION

Accordingly, it is an object of the invention to provide daughtercard mating contacts that form reliable connections with backplane mating contacts. It is another object of the invention to provide mating contacts which have a low initial insertion force and a normal working force when fully mated. It is yet another object of the invention to provide a contact assembly with contacts bearing on a divider, separating the mating contacts having equal and opposite forces provides a self-centering effect when the connector halves are mated.

An electrical connector has a first wafer having a first housing with a first plurality of beam contacts extending from the first housing in a first plane. A second wafer has a second housing with a second plurality of beam contacts extending from said second housing in a second plane substantially parallel to the first plane. A contact divider extends from the insulative housing between the first plurality of beam contacts and the second plurality of beam contacts.

The first and second wafers form a wafer pair having a first connector. The wafer pair has a first side that includes the first plurality of daughtercard beam contacts and a second side that includes the second plurality of daughtercard beam contacts. A backplane connector has a plurality of backplane contacts aligned in first and second rows with a channel therebetween. The wafer pair is received in the channel so that the first plurality of daughtercard beam contacts mates with the first row of backplane contacts and the second plurality of daughtercard beam contacts mates with the second row of backplane contacts.

In a preferred embodiment, each of the daughtercard beam contacts has a curved contact section that forms a first contact point. Each of the backplane contacts is a beam contact having a curved contact section that forms a second contact point. The contact sections of the daughtercard beam contacts are compressed toward the center of the channel when the daughtercard connector is initially inserted to connect with the backplane connector. The contact sections of the backplane beam contacts are compressed away from the center of the channel when the wafer pair is initially inserted to connect with the backplane connector. As the daughtercard connector is further received by the backplane connector, electrical connections are maintained between the first contact points and corresponding backplane beam contacts, and between the second contact points and corresponding daughtercard beam contacts. The connector has a low initial insertion force, but a reliable force when fully mated.

In alternative embodiments, each of the daughtercard beam contacts has a first curved contact section that forms a first contact point, a second curved contact section that forms a second contact point, and a pivot member therebetween. Each of the backplane contacts is a stationary contact blade. The first contact section is compressed toward the center of the channel when the daughtercard connector is initially inserted to connect with the backplane connector, thus forcing the second contact section away from the center of the channel. As the daughtercard connecter is further received by the backplane connector, the second contact section mates with the backplane blade and forces the first contact section away from the center of the channel. The connector has a low initial insertion force, but a high normal force when fully mated.

These and other objects of the invention, as well as many of the intended advantages thereof, will become more readily apparent when reference is made to the following description, taken in conjunction with the accompanying drawings.

BRIEF DESCRIPTION OF THE FIGURES

FIG. 2 is a partial view of assembled beam contacts in accordance with a first embodiment of the invention:

FIG. 3 is a partial view of individual beam contacts in accordance with a first embodiment of the invention:

FIG. 4 is a partial view of individual beam contacts in accordance with a first embodiment of the invention, featuring the contact interface;

DETAILED DESCRIPTION OF THE PREFERRED EMBODIMENTS

Figure 1:
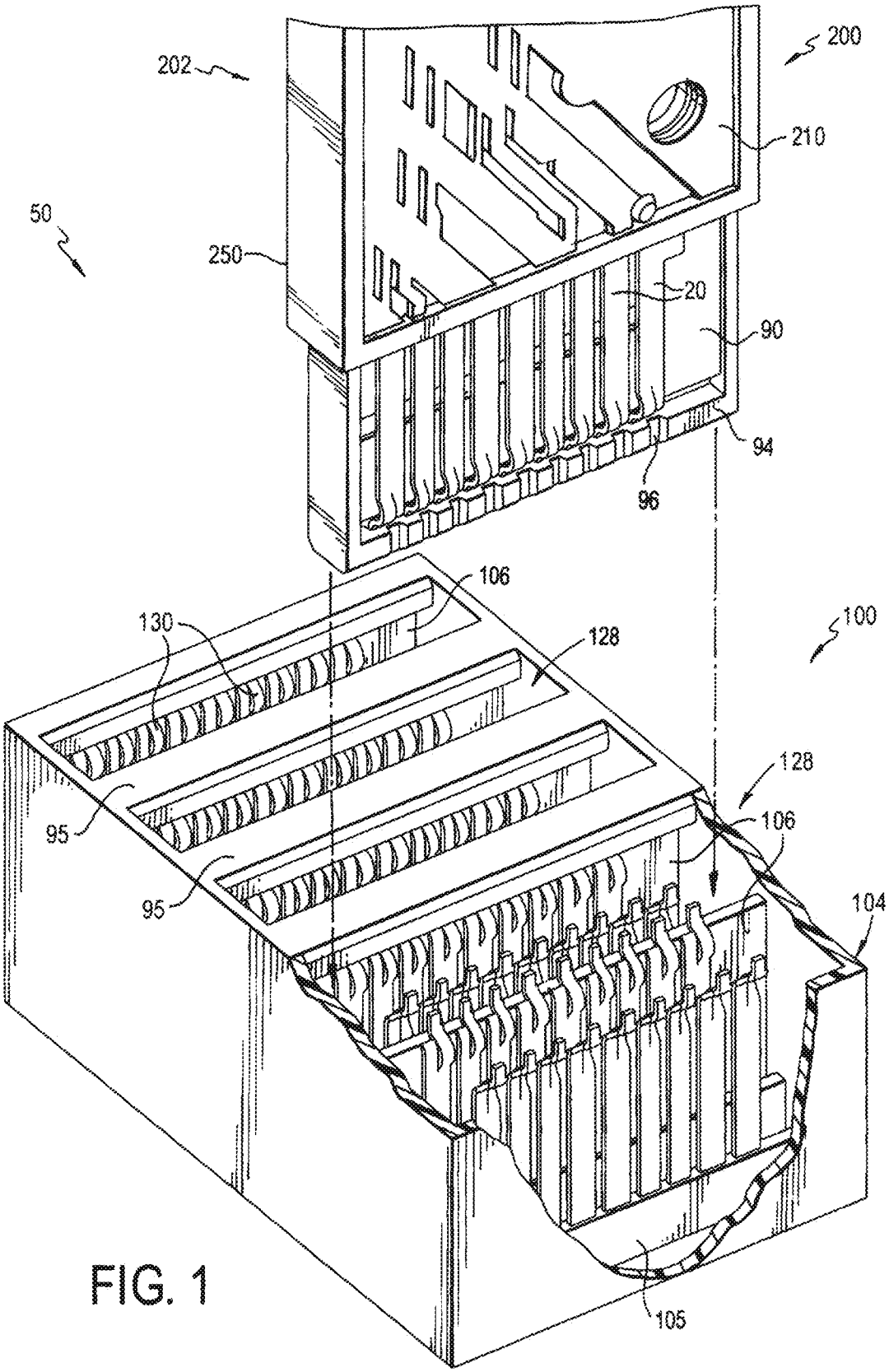
FIG. 1 is a diagram of the connector in accordance with the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

Turning to the drawings, FIG. 1 shows an electrical interconnection system 50 which includes a backplane connector 100 and daughtercard connector 200. The backplane connector 100 connects to a backplane or PCB (not shown). The daughtercard connector 200 has a wafer pair 202 which mates with the backplane connector 100 and connects to a daughtercard (not shown). The daughtercard connector 200 creates electrical paths between a backplane and a daughtercard. Though not expressly shown, the interconnection system 50 may interconnect multiple daughtercards having similar daughtercard connectors that mate to similar backplane connectors on the backplane. The number and type of subassemblies connected through the interconnection system 50 is not a limitation on the invention.

Accordingly, the invention is preferably implemented in a wafer connector having mating contacts, and preferably dual beam mating contacts. However, the invention can be utilized with any connector and mating contacts, and is not limited to the preferred embodiment. For instance, the present invention can be implemented with the connectors shown in U.S. Pat. No. 7,794,240 to Cohen et al., U.S. Pat. No. 7,722,401 to Kirk et al., U.S. Pat. No. 7,163,421 to Cohen et al., and U.S. Pat. No. 6,872,085 to Cohen et al., the contents of which are hereby incorporated by reference.

The backplane connector 100 is in the form of a shroud 104 that houses backplane contacts 130. The shroud 104 has a front wall, a rear wall, and two opposite side walls, which form a closed rectangular shape and form an interior space. A plurality of panel inserts 106 are provided in the interior space of the shroud 104. The panel inserts 106 are arranged in rows, which are parallel with each other and with the front and the rear walls of the shroud 104. Channels 128 are formed between the panel inserts 106, and each wafer pair 202 is received in one of the channels 128. The shroud 104 is preferably made of an electrically insulative material.

Each panel insert 106 has two opposing sides forming a first surface on the first side and a second surface on the second side. The first surface faces toward the front wall and the second surface faces opposite the first surface, i.e. toward the rear wall. The backplane contacts 130 are positioned along the first and second surfaces of each panel insert 106, and also along the inside surfaces of the front and rear walls. The backplane contacts 130 may be attached to the surfaces by an adhesive or mechanical connection. The backplane contacts 130 are preferably an electrically conductive material. The contacts 130 are aligned along the inside surfaces of the front and rear walls and along each surface of the panel inserts 106 in parallel planes. As shown in FIGS. 1-8, the backplane contacts 130 are preferably in the form of flexible beam contacts 21 that extend up through the floor of the shroud 104 and have contact tails that extend out of the bottom of the shroud 104. The backplane contacts 130 may extend through supporting structures 105 disposed in the shroud 104.

In the present embodiment wherein the backplane contacts 130 are in the form of flexible beam contacts 21, each panel insert 106 has a panel nose 95. In FIG. 1, however, some panel inserts 106 are depicted without panel noses 95 so that features of the backplane contacts 130 are more clearly visible in the figure. Each panel nose 95 extends from one side wall of the shroud 104 to the other, and provides cross support for the backplane connector 1X). Each panel insert 106 and panel nose 95 is fixed to both of the side walls of the shroud 104. The panel inserts 106 and the panel noses 95 provide rigid support to the backplane contacts 130 during insertion of the daughtercard connector 200 into the backplane connector 100. Wherein the backplane contacts 130 are in the form of flexible beam contacts 21, the panel inserts 106 and the panel noses 95 allow the backplane beam contacts 21 to flex upon insertion of the daughtercard connector 200 into the backplane connector 100. The panel inserts 106 and the panel noses 95 are fixed to the side walls of the shroud 104, and may be integral with the shroud 104, or coupled to the shroud 104. For example, the panel inserts 106 may be slidably received in grooves provided on the inside surfaces of each of the side walls of the shroud 104.

The assembly of the wafer pair 202 is described with reference to FIG. 1, which shows the wafer pair 202 having a first wafer 210, a second wafer 250, and a lossy plate (not shown). The first and second wafers 210, 250 and the lossy plate are combined to form the layered wafer pair 202. In a first step, the lossy plate is combined with the first wafer 210 by aligning respective attachment means (such as holes in the lossy plate and connection hubs on the first wafer 210). The attachment means (such as holes) of the second wafer 250 are then aligned with the attachment means of the first wafer 210 to mate the second wafer 250 to the first wafer 210. Accordingly, the second wafer 250 is connected to the first wafer 210 with the lossy plate sandwiched therebetween. The second wafer 250 locks the lossy plate in place on the first wafer 210.

As best shown in FIGS. 5-8, each of the first and second wafers 210, 250 has an insulative housing with daughtercard beam contacts 20 extending from the bottom of each of the insulative housings. The daughtercard beam contacts 20 may form dual beam mating contacts as shown in FIG. 1, or may be single beam contacts as shown in FIGS. 2-19. A one-piece integral contact divider 90 is inserted between the daughtercard beam contacts 20 of the first wafer 210 and the daughtercard beam contacts 20 of the second wafer 250. The contact divider 90 has a separation panel 92 and a divider nose 94. The contact divider 90 extends the entire length of the daughtercard beam contacts 20 to support and also form a barrier between the daughtercard beam contacts 20 of the first wafer 210 and the daughtercard beam contacts 20 of the second wafer 250. The contact divider 90 is insulative. As shown in FIG. 1, the divider nose 94 may include contours 96 to allow for easy insertion of the daughtercard connector 200 into the backplane connector 100.

The contact divider 90 has attachment means which connects with respective attachment means on the housings of the wafers 210, 250. For instance, the attachment means of the divider 30 can be a tab which forms a concave curve, and the attachment means of the wafers 210, 250 can be curved projections facing outward on the sides of the wafers 210, 250. Accordingly, the concaved tabs slide over the curved projections. The tabs are biased inwardly, so that the projections are fixedly received in the tabs. The tabs of the contact divider 90 are preferably about as wide as both of the wafers 210, 250 joined together.

Figure 5:
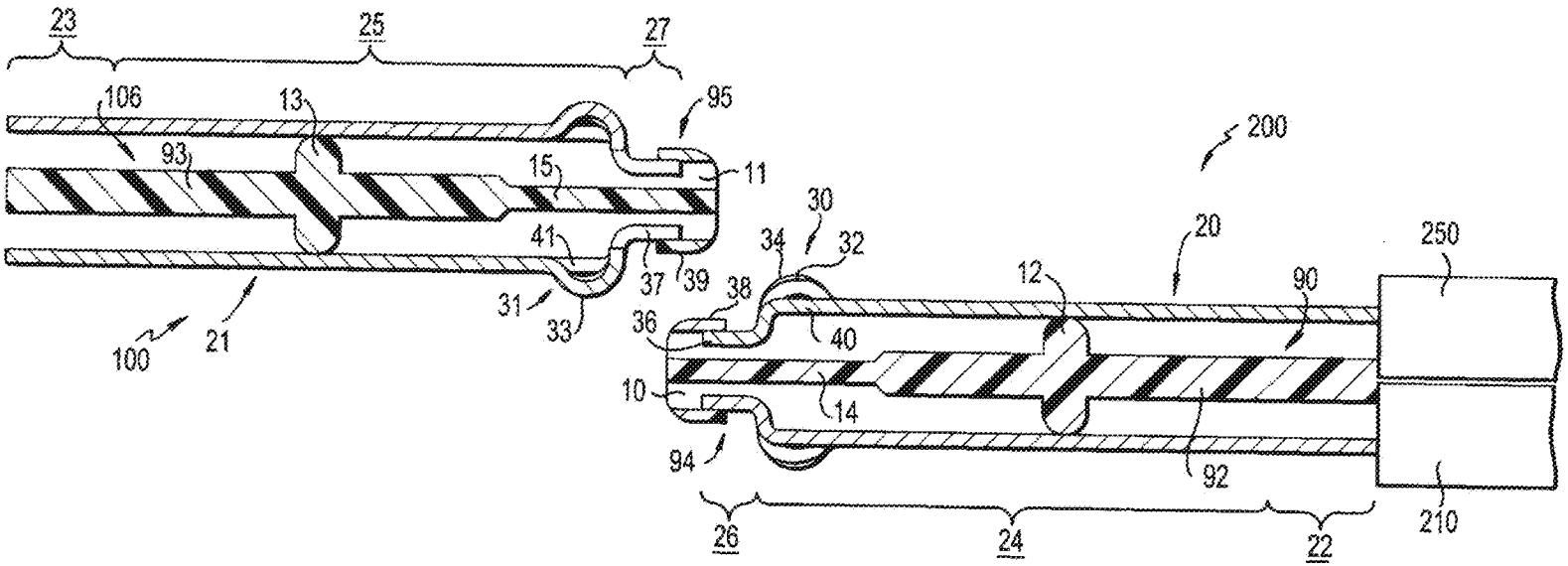
FIG. 5 is a cross-section of mating contacts with a central divider in the pre-engagement position in accordance with a first embodiment of the invention.

FIGS. 2-8 show views of the daughtercard beam contacts 20 for the two wafers 210, 250 respectively, and the contact divider 90. The daughtercard beam contacts 20 can be either signal contacts or ground contacts. As best shown in FIG. 5, each daughtercard beam contact 20 has a proximal end 22, an intermediate portion 24, and a distal end 26. The proximal ends 22 extend from the insulative housings of the first and second wafers 210, 250, respectively, and are flat.

The intermediate portion 24 is also flat, but has a curved contact section 30 toward the distal end 26. The curved contact section 30 protrudes outward, away from the separation panel 92 to form a first contact point 32. A lossy or conductive coating or a metal contact pad 34 may be placed on the outside surface of the first contact section 30. Referring to FIGS. 2-4, the section of the intermediate portion 24 nearest the distal end 26 is split along a central longitudinal axis of the daughtercard beam contact 20 to form two fingers 60, 62. One of the fingers 60 forms the curved contact section 30 on one side (e.g., the left side in the embodiment shown in FIGS. 3 and 4) of the split, and the other finger 62 forms a flat section 40 on the other side (e.g., the right side in the embodiment shown in FIGS. 3 and 4) of the split. In the embodiment shown, the finger 62 forming the flat section 40 extends to the distal end 26 of the daughtercard beam contact 20, and is longer than the finger 60 forming the contact section 30. The finger 60 forming the contact section 30 terminates approximately where the flat section 40 ends, and does not extend to the distal end 26 of the daughtercard beam contact so that it does not interfere with the divider nose 94. Accordingly, each daughtercard beam contact 20 has a first contact point 32, which forms the outermost point of the daughtercard beam contact 20.

Turning back again to FIG. 5, the daughtercard beam contacts 20 have tabs 36 at the distal ends 26, which are positioned inside the divider nose 94. The tabs 36 may be offset by a double curved s-shaped section so that the tabs 36 are closer to the separation panel 92 than the proximal ends 22. The tab 36 of each distal end 26 is substantially parallel to the proximal end 22 and the flat section 40 of the intermediate portion 24. In the embodiment shown, the distal end 26 of each daughtercard beam contact 20 extends from the flat section 40 of the intermediate portion 24 such that the width of the distal end 26 is less than the width of the proximal end 22 and the intermediate portion 24.

Figure 20:
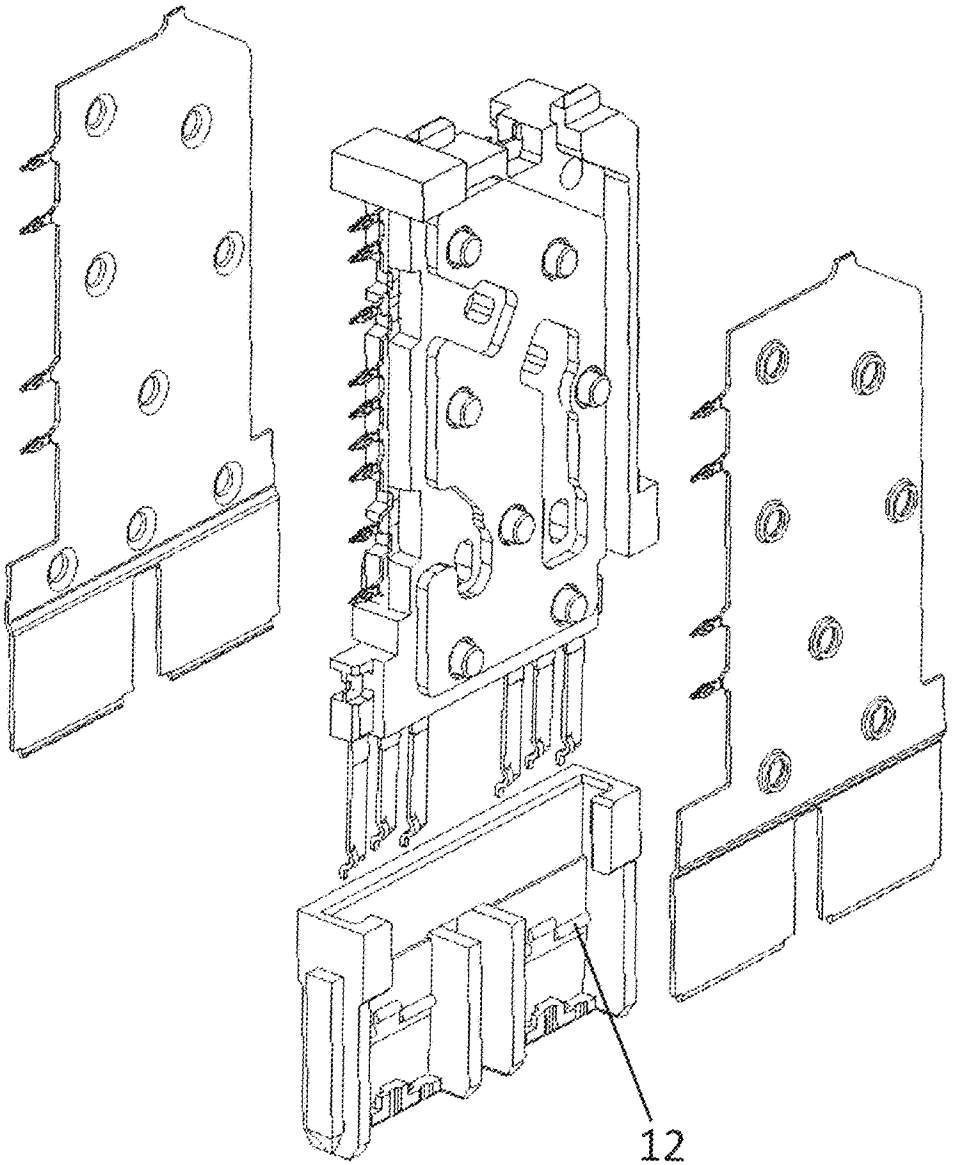
FIG. 20 is an exploded view of the wafer.

The contact divider 90 has a separation panel 92 and a divider nose 94. A pivot bar 12 in the form of a semi-circular ridge is provided on each side of the separation panel 92. The pivot bar 12 may be positioned slightly closer to the distal end 26 of the daughtercard beam contact 20 than the proximal end 22 of the daughtercard beam contact 20, but is preferably positioned approximately midway between the distal end 26 and the proximal end 22 of the daughtercard beam contact 20. The pivot bar 12 extends across the entire width of the separation panel 92. However, the pivot bar 12 need not be continuous along each side of the separation panel 92. Rather, the pivot bar 12 can have breaks or gaps and may be offset with respect to each other, such as shown in FIG. 20. The pivot bar 12 may have a different configuration, corresponding to the configuration of the daughtercard beam contacts 20, on each side of the separation panel 92. For example, a break or gap in the pivot bar 12 may correspond to a space between two adjacent daughtercard beam contacts 20. In cases where the pivot bar 12 includes breaks, the various pivot bar segments may be positioned on the separation panel 92 at varying distances from the divider nose 94. For example, pivot bar segments used for the wider daughtercard ground beam contacts may be positioned at a greater distance from the divider nose 94 than pivot bar segments used with the narrower daughtercard signal beam contacts. Thus, the adjacent pivot bar segments can be at staggered distances from the divider nose 94 depending on the widths of the respective daughtercard beam contacts 20. Because the different widths result in different amounts of flexibility, the pivot bar segments provide a correction to equalize the flexibilities. This allows for the individual daughtercard beam contacts 20 to have substantially equal insertion forces during the mating of the daughtercard connector 200 and the backplane connector 100, regardless of the widths of the individual daughtercard beam contacts 20.

In addition, the separation panel 92 has a reduced end portion 14 substantially aligned with the distal end 26 and a part of the intermediate portion 24 of the daughtercard beam contact 20. The reduced end portion 14 has a reduced thickness with respect to the rest of the separation panel 92, allowing for a greater range of motion of the distal ends 26. The reduced end portion 14 may be tapered such that the thickness of the reduced end portion 14 nearest the distal end 26 is less than the thickness of the reduced end portion 14 nearest the proximal end 22.

As shown in FIG. 5, the divider nose 94 receives the distal ends 26 of the daughtercard beam contacts 20. The divider nose 94 is positioned at the leading end of the contact divider 90. The divider nose 94 has a width, which is substantially orthogonal to the plane of the separation panel 92. That is, the contact divider 90 forms a general T-shape where the separation panel 92 connects with the divider nose 94. The separation panel 92 symmetrically divides the divider nose 94. Accordingly, the divider nose 94 extends outwardly from each side of the separation panel 92.

Openings 10 are provided in the divider nose 94 which extend partly or entirely through the divider nose. The openings 10 accept the distal ends 26 of the daughtercard beam contacts 20. The openings 10 also form preload stops 38, which restrict the maximum separation distance between the two opposing daughtercard beam contacts 20. The openings 10 allow the distal ends 26 to move transversely toward and away from the separation panel 92 when the daughtercard beam contacts 20 are mated with the backplane beam contacts 21. The entire daughtercard beam contact 20 is biased slightly outward by an angle of about 3-5 degrees from the separation panel 92 so that when retained by the divider nose 94, the daughtercard beam contact 20 has a preload force which must be overcome to move the distal ends 26 of the daughtercard beam contacts 20 inward toward the separation panel 92. This allows for a more reliable connection between the backplane beam contact 21 and the daughtercard beam contact 20.

The very tips of the tabs 36 at the distal ends 26 are rounded so that the daughtercard beam contacts 20 can slide into the divider nose 94 without stubbing. In addition, the divider nose 94 has a rounded outer surface to guide the divider nose 94 between two backplane beam contacts 21 without stubbing during mating.

FIGS. 2-8 also show views of the backplane beam contacts 21 and the panel insert 106. The backplane beam contacts 21 and the panel inserts 106 extend from the floor of the backplane connector 100. The backplane beam contacts 21 can be either signal contacts or ground contacts. The backplane beam contacts 21 and the panel inserts 106 are the same as the daughtercard beam contacts 20 and the contact dividers 90, respectively, with regard to their construction, shape, and function. Accordingly, the description of those like elements is incorporated here and need not be repeated. For example, each panel insert 106 has a separation panel 93, a panel nose 95, and a pivot bar 13, which are the same as the daughtercard separation panel 92, divider nose 94, and pivot bar 12, respectively. The inside surfaces of the walls of the shroud 104 that are parallel to the panel inserts 106 are configured similar to the panel inserts 106. The panel inserts 106 can form a single continuous wall, as shown in FIG. 1, or can be separate panels aligned in a row.

FIG. 5 shows a portion of the backplane connector 100 including a backplane beam contact 21 having a proximal end 23, an intermediate portion 25, and a distal end 27. The backplane beam contact 21 also has fingers 61, 63 (FIGS. 2-4) forming a contact section 31, a second contact point 33, a flat section 41, and a tab 37. The panel insert 106 has a separation panel 93, a pivot bar 13, a reduced end portion 15, and a panel nose 95. The panel nose 95 includes openings 11 and preload stops 39.

The operation of the invention will now be discussed with reference to FIGS. 5-8. At the stage shown, the daughtercard beam contacts 20 and the backplane beam contacts 21 are fully assembled and the daughtercard connector 200 is ready to be inserted into and received by the backplane connector 100 (FIG. 1). As best shown in FIGS. 3 and 4, the contact section 31 of the backplane beam contact 21 aligns with the flat section 40 of the intermediate portion 24 of the daughtercard beam contact 20. Similarly, the contact section 30 of the daughtercard beam contact 20 aligns with the flat section 41 of the intermediate portion 25 of the backplane beam contact 21. Returning to FIG. 5, prior to the engagement of the daughtercard connector 200 and the backplane connector 100, the tabs 36 are positioned against the preload stops 38 due to the outward bias of the daughtercard beam contacts 20 and the preload force created by the pivot bar 12. Similarly, tabs 37 are positioned against the preload stops 39 due to the outward bias of the backplane beam contacts 21 and the preload force created by the pivot bar 13.

Figure 6:
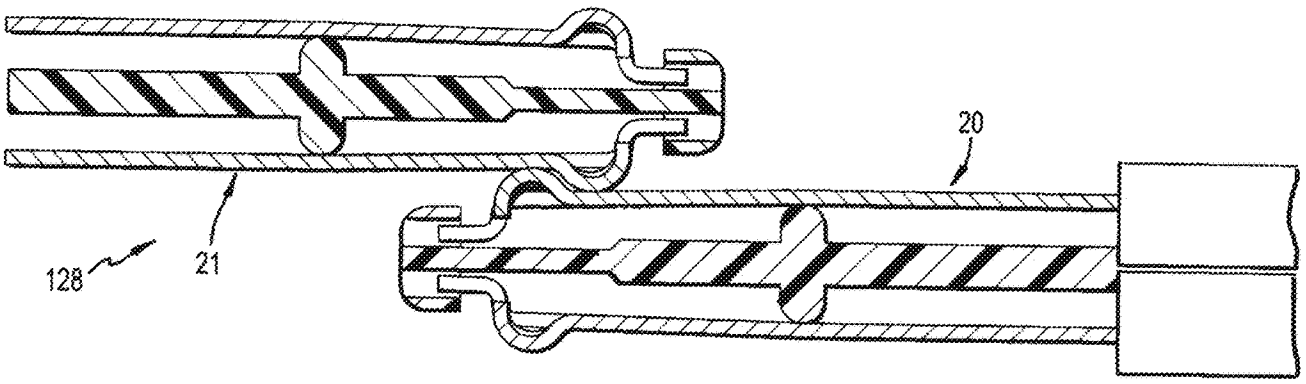
FIG. 6 is a cross-section of mating contacts with a central divider in the initial engagement position in accordance with a first embodiment of the invention.

FIG. 6 shows the initial engagement of the daughtercard beam contacts 20 and the backplane beam contacts 21. In this position, the distal ends 26 of the daughtercard beam contacts 20 have just entered the shroud 104, and are received in the channel 128 between a first row of backplane beam contacts 21 and a second row of backplane beam contacts (not shown in FIGS. 5-8). As each daughtercard beam contact 20 slidably engages the corresponding backplane beam contact 21, the curved contact section 30 of the daughtercard beam contact 20 comes into contact with and slides along the flat section 41 of the intermediate portion 25 of the backplane beam contact 21, passing the curved contact section 31 of the backplane beam contact. At the same time, the curved contact section 31 of the backplane beam contact 21 slides along the flat section 40 of the intermediate portion 24 of the daughtercard beam contact 20, passing the curved contact section 30 of the daughtercard beam contact 20. In doing so, the first contact point 32 contacts the backplane beam contact 21 and the second contact point 33 contacts the daughtercard beam contact 20. Because the contact sections 30 of the daughtercard beam contact 20 and the backplane beam contact 21 are curved, there is no stubbing of the daughtercard beam contact 20 or the backplane beam contact 21.

The backplane beam contact 21 compresses the daughtercard beam contact 20 inwardly toward the separation panel 92 and the center of the channel 128, against the preload outward bias of the daughtercard beam contact 20. Likewise, the daughtercard beam contact 20 compresses the backplane beam contact 21 inwardly toward the separation panel 93 and away from the center of the channel 128, against the outward bias of the backplane beam contact 21. The intermediate portion 24 of the daughtercard beam contact 20 pivots slightly about its respective pivot bar 12 as the contact section 30 rides up onto the flat section 41. Likewise, the intermediate portion 25 of the backplane beam contact 21 pivots slightly about its respective pivot bar 13 as the contact section 31 rides up onto the flat section 40.

In response to the compression of the daughtercard beam contact 20, the distal end 26 of the daughtercard beam contact 20 is deflected away from its respective preload stop 38 toward the separation panel 92, and into the opening 10 against the preload force. Likewise, in response to the compression of the backplane beam contact 21, the distal end 27 of the backplane beam contact 21 is deflected away from its respective preload stop 39 toward the separation panel 93, and into the opening 11 against the preload force. The portion of the daughtercard beam contact 20 on the side of the pivot bar 12 closest to the wafer 210, 250 bows outward slightly.

Figure 7:
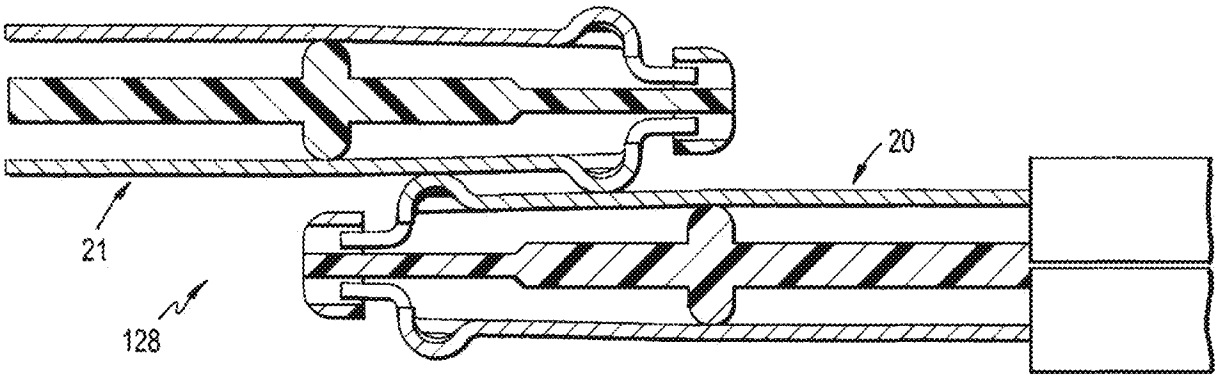
FIG. 7 is a cross-section of mating contacts with a central divider in the intermediate engagement position in accordance with a first embodiment of the invention.

FIG. 7 shows the intermediate engagement of the daughtercard beam contacts 20 and the backplane beam contacts 21. In this position the daughtercard connector 200 is received further into the backplane channel 128. The distal end 26 of the daughtercard beam contact 20 is further deflected away from its respective preload stop 38, and the distal end 27 of the backplane beam contact 21 is further deflected away from its respective preload stop 39. Accordingly, the normal forces applied by the daughtercard contact section 30 and the backplane contact section 31 are increased. The contact section 30 slides along the intermediate portion 25 of backplane beam contact 21 as contact section 31 slides along the intermediate portion 24 of daughtercard beam contact 20.

Figure 8:
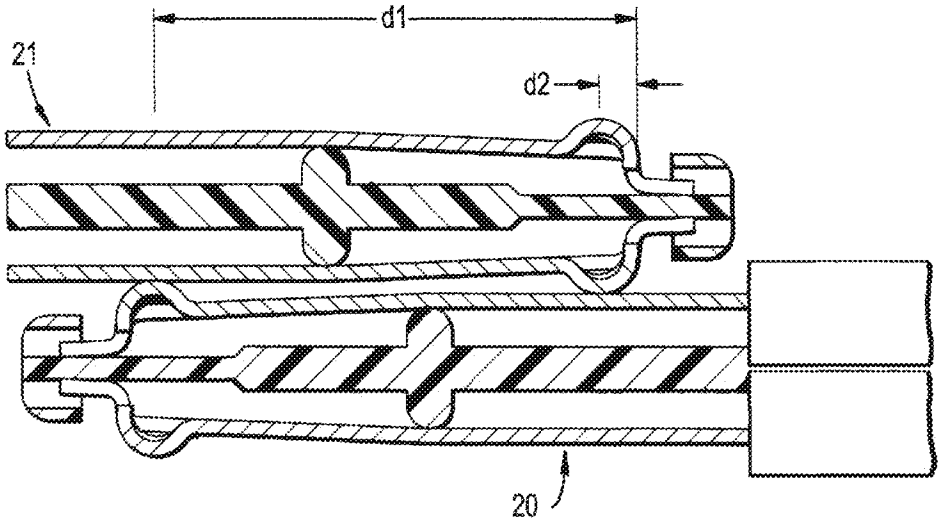
FIG. 8 is a cross-section of mating contacts with a central divider in the final engagement position in accordance with a first embodiment of the invention.

FIG. 8 shows the final engagement of the daughtercard beam contacts 20 and the backplane beam contacts 21. In this position the daughtercard connector 200 is completely received within the channel 128. The curved contact section 30 of the daughtercard beam contact 20 has traveled past the backplane pivot bar 13, and the curved contact section 31 of the backplane beam contact 21 has traveled past the daughtercard pivot bar 12. The normal forces applied by the daughtercard contact section 30 and the backplane contact section 31 reach their maxima just before and after they slide past the backplane pivot bar 13 and the daughtercard pivot bar 12, respectively. Plastic (not shown) may be provided at the proximal ends of the contact divider 90 and the panel insert 106 to fully support the beam contacts 20, 21.

Referring to FIGS. 6-8, the normal forces applied by the daughtercard contact section 30 and the backplane contact section 31 increase throughout the engagement of the daughtercard connector 200 with the backplane connector 100. During the initial engagement stage (FIG. 6), the normal forces increase at a substantially constant rate. During the intermediate engagement stage (FIG. 7), the normal forces increase at a substantially constant rate that is higher than the rate of increase during initial engagement stage. During the final engagement stage (FIG. 8), the normal forces increase at a substantially constant rate that is between that of the initial engagement stage and the intermediate engagement stage until the normal forces reach their maxima, at which point the normal forces remain substantially constant until engagement is complete. Accordingly, the invention provides a low insertion force and a reliable normal force when fully mated.

As further shown in FIG. 8, the invention minimizes the stub length of the connections between the daughtercard beam contacts 20 and the backplane contacts 130. More specifically, the stub distance d2 from the second contact point 33 to the leading end of the backplane beam contact 21 is significantly reduced, and is especially much shorter than the stub distance d1 between the first contact point 32 and the end of the backplane beam contact 21. This is particularly important with high signal frequencies which may cause a larger stub length to behave like an antenna. The addition of the second contact point 33 and the resulting shorter stub distance d2 reduces the likelihood of antenna behavior, thus reducing cross-talk.

The construction of the daughtercard beam contact 20 is similar to the construction of the backplane beam contact 21. However, the contact section 30 of the daughtercard beam contact 20 and the contact section 31 of the backplane beam contact 21 are not aligned. Rather, the contact section 30 of the daughtercard beam contact 20 aligns with the flat section 41 of the backplane beam contact 21. The contact section 31 of the backplane beam contact 21 aligns with the flat section 40 of the daughtercard beam contact 20. Thus, fingers 60, 62 of the daughtercard beam contacts 20 are switched compared to the fingers 61, 63 of the mating backplane beam contacts 21. The backplane contacts 130 are preferably flexible, as shown in FIGS. 2-8, but can be fixed within the shroud, as shown in the alternate embodiments of FIGS. 15, 16, 18, and 19.

Figure 9:
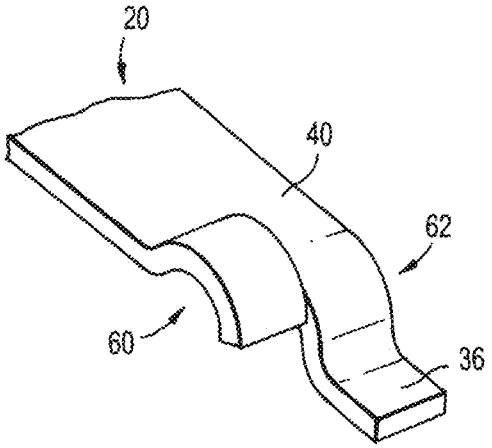
FIG. 9 is a partial view of an individual beam contact in accordance with a first embodiment of the invention, featuring the contact interface.
Figure 10:
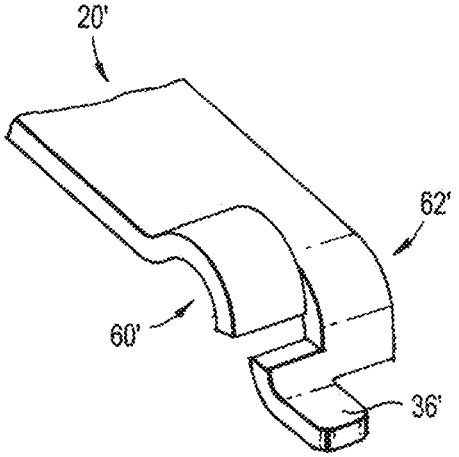
FIG. 10 is a partial view of an individual beam contact in accordance with a second embodiment of the invention, featuring the contact interface.

FIGS. 9 to 13 show examples of additional configurations for daughtercard beam contacts 20, 20' in accordance with the present invention, FIG. 9 illustrates that the tab 36 may be positioned at the end of the flat section 40. Alternatively, the tab 36' can have an inward jog to be offset inwardly such that a central axis of the tab 36' aligns with the split between the two fingers 60', 62', as shown in FIG. 10. Backplane beam contacts 21 can be identical to the daughtercard beam contacts 20, 20' of FIGS. 9 and 10.

Figure 11:
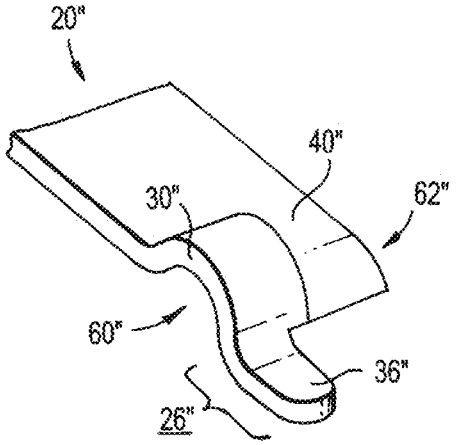
FIG. 11 is a partial view of an individual beam contact in accordance with a third embodiment of the invention, featuring the contact interface.
Figure 12:
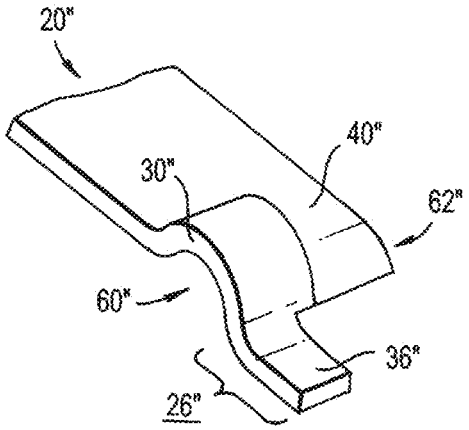
FIG. 12 is a partial view of an individual beam contact in accordance with a third embodiment of the invention, featuring the contact interface.

FIGS. 11 and 12 show the finger 60" wherein the contact section 30" forms the very distal end 26" of the daughtercard beam contact 20", and is longer than the finger 62" having the flat section 40". The finger 62" having the flat section 40" does not extend to the distal end 26" of the daughtercard beam contact 20". The finger 62" having the flat section 40" ramps slightly in a direction opposite the protrusion of the contact section 30". In the embodiment of FIG. 12, the contact section 30" extends upward, and the finger 62" ramps downwardly. The distal end 26" of the daughtercard beam connector 20" has a tab 36", which may be substantially rounded, as shown in FIG. 11, or may be substantially square, as shown in FIG. 12. Only a portion of the finger 60" extends out as the tab 36".

Figure 13:
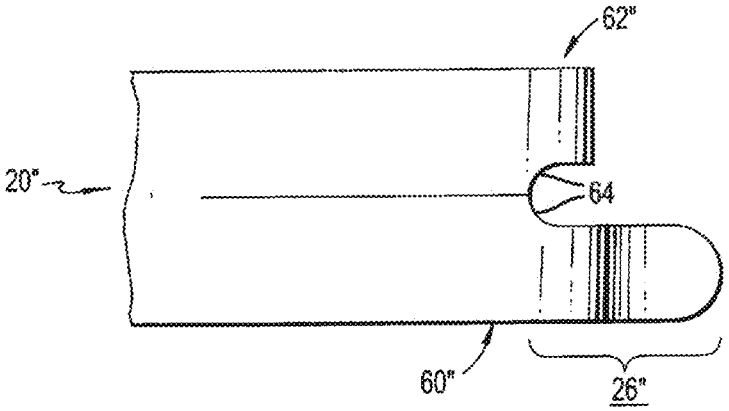
FIG. 13 is a plan view of the individual beam contacts of FIGS. 11 and 12.

FIG. 13 is a plan view of the daughtercard beam contact 20" shown in FIGS. 11 and 12. FIG. 13 illustrates that the fingers 60", 62" may include a rounded concave section 64 near the portion of the split nearest the distal end 26". Backplane beam contacts 21 may be formed similarly to the daughtercard beam contacts 20" of FIGS. 11, 12, and 13.

The configurations shown in FIGS. 10-12 are advantageous in that the tabs 36', 36" require less metal than the tabs 36 of FIGS. 2-9, thereby allowing the signal density of the daughtercard connector 200 or backplane connector 100 to be increased. Additionally, the configurations shown in FIGS. 1-12, having a ramped finger 62" and a finger 60" with both a contact section 30" and a tab 36", are less prone to catching during the mating of the daughtercard connector 200 and the backplane connector 100. All the configurations shown in FIGS. 2-8 provide reliable contact between the daughtercard beam contacts 20, 20', 20", and the backplane beam contacts 21.

FIGS. 14-19 show an alternate embodiment wherein the backplane contacts 130 are in the form of electrically conductive stationary blades 126 that extend up through the floor of the shroud 104 and have contact tails that extend out of the bottom of the shroud 104. The contact tails connect to a backplane or PCB. The signal contacts are preferably configured as differential pairs, but can also be single signal contacts. In embodiments wherein the backplane contacts 130 are in the form of stationary blades 126, the panel inserts 106 need not be provided or can be provided without panel noses 95.

Figure 14:
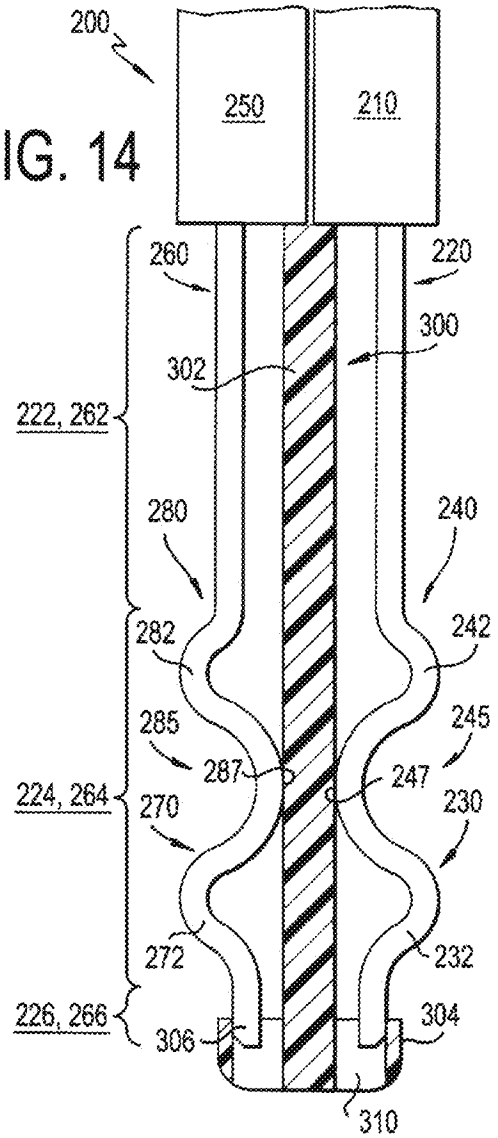
FIG. 14 is a cross-section of mating contacts with a central divider in accordance with a fourth embodiment of the invention.

Another embodiment of the invention is shown in FIG. 14, which shows a cross-sectional view of beam contacts 220, 260 for the two wafers 210, 250, respectively, and the contact divider 300. The contacts 220, 260 can be either signal contacts or ground contacts. Each beam contact 220, 260 has a proximal end 222, 262, an intermediate portion 224, 264, and a distal end 226, 266, respectively. The proximal ends 222, 262 extend from the insulative housings of the two wafers 210, 250, respectively. At the distal end 226, 266, each beam contact 220, 260 is positioned inside the divider nose 304 against the preload stop 306.

The proximal ends 222, 262 and the distal ends 226, 266 of the signal beam contacts 220, 260 are flat. The intermediate sections 224, 264 each have a first curved contact section 230, 270, a second curved contact section 240, 280, and a curved spring section 245, 285, located therebetween. The first curved contact sections 230, 270 project outward, away from the separation panel 302, to form outermost first contact points 232, 272. The second curved contact sections 240, 280 are project outward, away from the separation panel 302, to form outermost second contact points 242, 282. The spring sections 245, 285 are inversely curved with respect to the first contact sections 230, 270 and the second contact sections 240, 280. The spring sections 245, 285 project inwardly to form inner most pivot points 247, 287 on the inside facing surface of the beam contacts 220, 260. The inner pivot points 247, 287 come into contact with the separation panel 302. The spring sections 245, 285 can have a reduced thickness.

Accordingly, the first beam contact 220 has a first contact point 232 and a second contact point 242 which form the outermost points of the beam contact 220, with the first contact point 232 projecting outward slightly farther than the second contact point 242. The entire beam contact 220 is biased slightly outward by an angle of about 3-5 degrees from the separation panel 302. However, the first contact section 230 positions the distal end 226 to be slightly closer to the separation panel 302 than the proximal end 222. Likewise, the second beam contact 260 has a first contact point 272 and a second contact point 282 which form the outermost points of the beam contact 260, with the first contact point 272 projecting outward slightly farther than the second contact point 282. The entire beam contact 260 is biased slightly outward by an angle of about 3-5 degrees from the separation panel 302. However, the first contact section 270 positions the distal end 266 to be slightly closer to the separation panel 302 than the proximal end 262.

As shown in FIG. 14, the divider nose 304 receives the distal ends 226, 266 of the beam contacts 220, 260. The divider nose 304 is positioned at the leading end of the contact divider 300. The divider nose 304 has a width, which is substantially orthogonal to the plane of the separation panel 302. That is, the contact divider 300 forms a general T-shape where the separation panel 302 connects with the divider nose 304. The separation panel 302 symmetrically divides the divider nose 304. Accordingly, the divider nose 304 extends outwardly from each side of the separation panel 302.

As shown in FIG. 14, the divider nose 304 receives the distal ends 226, 266 of the beam contacts 220, 260. The divider nose 304 is positioned at the leading end of the contact divider 300. The divider nose 304 has a width, which is substantially orthogonal to the plane of the separation panel 302. That is, the contact divider 300 forms a general T-shape where the separation panel 302 connects with the divider nose 304. The separation panel 302 symmetrically divides the divider nose 304. Accordingly, the divider nose 304 extends outwardly from each side of the separation panel 302.

Openings 310 are provided in the nose 304 which extend partly or entirely through the divider nose 304. The openings 310 accept the distal ends 226, 266 of the beam contacts 220, 260, respectively. Each opening 310 also forms a preload stop 306 which restricts the maximum separation distance between two opposing beam contacts 210, 250. The openings 310 allow the distal ends 226, 266 to move inward toward the separation panel 302 when the beam contacts 220, 260 are mated with the backplane blades 126. This flexibility is needed because the outer most portions of the beam contacts 220, 260 (i.e., the contact points 230, 240, 270, 280) are wider than the backplane blades 126.

As also shown, the very tips of the distal ends 226, 266 are beveled, so that the beam contacts 220, 260 can slide into the divider nose 304 without stubbing. In addition, the front sides of the divider nose 304 are angled to guide the divider nose 304 between the two backplane blades 126 without stubbing.

The assembly of the contact divider 300 will now be described. Once the first and second wafers 210, 250 are connected together, the contact divider 300 is placed between the beam contacts 220, 260. Prior to placing the distal ends 226, 266 of the beam contacts 220, 260 into the divider nose 304, the beam contacts 210, 250 are spring biased outward. The spring bias forms about a 6-10 degree angle between the beam contacts 210, 250 at the base of the wafer pair 202. As the contact divider 300 is moved further into the wafer pair 202 between the beam contacts 220, 260, the beam contacts 220, 260 are compressed together so the distal ends 226, 266 are close enough to each other to enter the cavity 310. The pivot points 247, 287 of the spring bends 245, 285 also come into contact with the separation panel 302, so that the spring bends 245, 285 push the beam contacts 220, 260 outwardly.

As the contact divider 300 continues to advance, the cavity 310 receives the distal ends 226, 266 and the compression is released so that the beam contacts 220, 260 press outward against the preload stop 306. Placing the distal ends 226, 266 into the divider nose 304 moves the beam contacts 220, 260 more in line with the plane of the wafer pair 202. The outward bias of the beam contacts 220, 260, and the outward force of the spring bends 245, 285, create a normal force against the preload stop 306 on the order of 30-60 grams. This pressure ensures that the beam contacts 220, 260 are in constant contact with the backplane blades 126 when the wafer pair 202 is inserted into the backplane connector 100.

Figure 15:
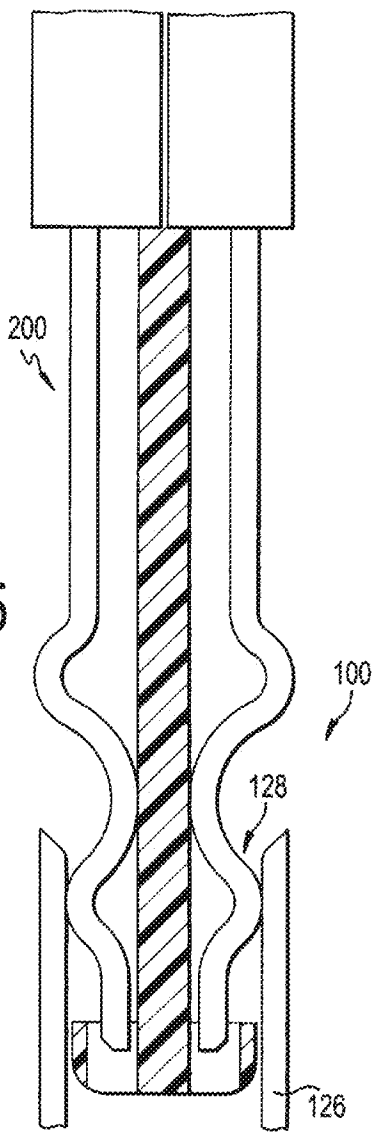
FIG. 15 is cross-section of the mating contacts of FIG. 9 during initial insertion between backplane blades.

At this point, as shown in FIG. 14, the wafer pair 202 is fully assembled with the contact divider 3X) in place. Prior to inserting the wafer pair 202 into the shroud 104, the distal ends 226, 266 are pressed against the inside wall of the preload stop 306 in the divider nose 304 by the force of the primary spring 245, 285 and the outward bias of the beam contacts 220, 260 themselves. As shown in FIG. 15, the wafer pair 202 is then inserted into the shroud 104 between the backplane blades 126. At this point, the first contact points 232, 272 contact the backplane blades 126. Because the first contact sections 230, 270 are rounded, there is no stubbing of the first contact sections 230, 270 as they mate with the backplane blades 126.

The backplane blades 126 force the first contact sections 230, 270 inward toward the separation panel 302, and away from the preload stops 306. The primary springs 245, 285 are stiffer than the secondary spring force of the proximal portion 222, 262. Accordingly, the backplane blades 126 cause the primary spring bend 245 to rock or pivot about pivot points 247, 287 and force the second contact sections 240, 280 outward in the direction of the backplane blades 126.

Figure 16:
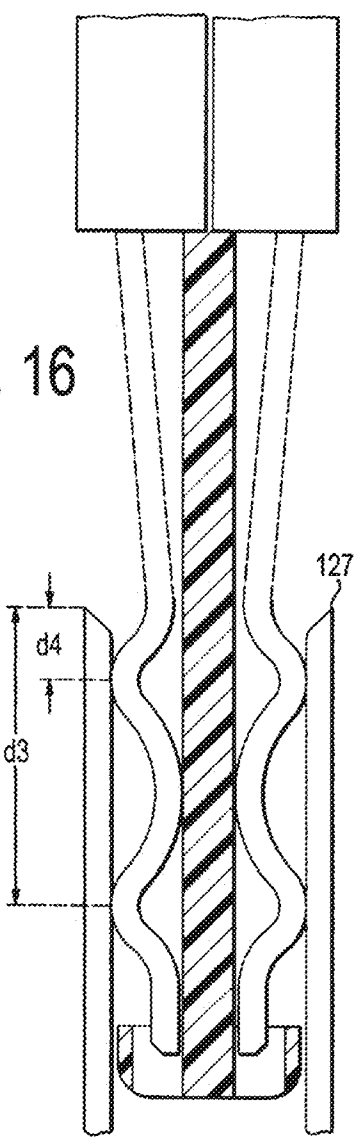
FIG. 16 is a cross-section of the mating contacts of FIGS. 9 and 10 during final insertion between the backplane blades, with the mating contacts fully mated with the backplane blades.

Turning to FIG. 16, the wafer pair 202 continues to be inserted into the shroud 104. The second contact sections 240, 280 enter between the backplane blades 126. The second contact sections 240, 280 are curved to prevent stubbing when engaging the backplane blades 126. The second contact points 242, 282 come into contact with the backplane blades 126. The backplane blades 126, which remain stationary, cause the primary spring bends 245, 285 and the secondary spring of each proximal end 222, 262 to deflect. Thus, the blades 126 force the second contact sections 240, 280 inward, causing the primary spring bends 245, 285 to rock or pivot back against the pivot points 247, 287. This pushes the first contact sections 230, 270 outward in the direction of the backplane blades 126, which forms a stronger mating contact between the first contact points 232, 272 and the backplane blades 126. In addition, the proximal ends 222, 262 of the beam contacts 220, 260 are forced inward by the backplane blades 126. The outward bias of the beam contacts 220, 260 also causes a strong mating contact between the second contact points 242, 282 and the backplane blades 126.

The beam contacts 220, 260 continue to be slidably received between the backplane blades 126 until the wafer pair 202 is fully seated in the shroud 104, as shown in FIG. 16. The force of the backplane blades 126 on the second contact sections 240, 280 also normalizes the force of the primary spring bend 245, 285 between the first contact sections 230, 270 and the second contact sections 240, 280. The first contact sections 230, 270 and the second contact sections 240, 280 exert equal outward forces against the backplane blades 126.

As further shown in FIG. 16, the invention minimizes the stub length of the connections between the beam contacts 220, 260 and the backplane blades 126. More specifically, the stub distance d4 from the second contact points 242, 282 to the leading end 127 of the backplane blades 126 is significantly reduced, and is especially much shorter than the stub distance d3 between the first contact point 232, 272 and the end 127 of the backplane blades 126. This is particularly important with high signal frequencies, which may cause a larger stub length to behave like an antenna. The addition of the second contact points 242, 282 and the resulting shorter stub distance d4 reduces the likelihood of antenna behavior, thus reducing cross-talk.

Further to this embodiment, the distance from the separation panel 302 to the inside of the first contact point 232, 272, when the wafer pair 202 is fully received in the shroud, is about 0.5 mm. The distance between the first contact points 232, 272 and the second contact points 242, 282, is about 1.5 mm. The separation panel 302 is about 0.3 mm wide.

Figure 17:
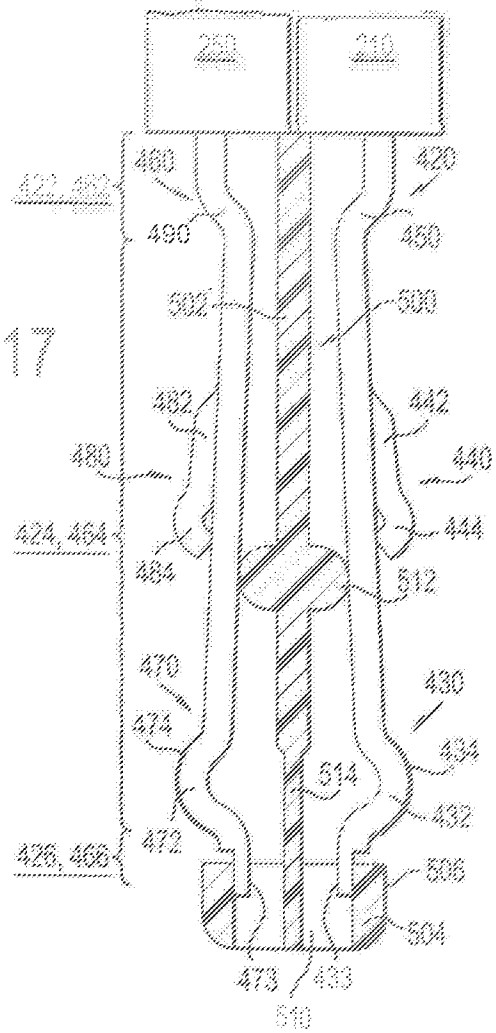
FIG. 17 is a cross-sectional diagram of mating contacts with a central divider in accordance with a fifth embodiment of the invention.

Turning to FIG. 17, another embodiment of the invention is shown having beam contacts 420, 460 and a contact divider 500. Here, the beam contacts 420, 460 are shown extending from the wafers 210, 250. The contact divider 500 is similar to the contact divider 300 shown in FIGS. 14-16, and has a T-shape configuration formed by a separation panel 502 and a divider nose 504. The divider nose 504 has openings 510 which receive the beam contacts 420, 460 and form a preload stop 506. However, the contact divider 500 of the present embodiment also has a pivot bar 512 in the form of a semi-circular ridge that extends across the entire width of the separation panel 502. The pivot bar 512 is slightly closer to the distal ends 426, 466 of the beam contacts 420, 460 than the proximal ends 422, 462 of the beam contacts 420, 460, but is approximately midway between the distal ends 426, 466 and the proximal ends 422, 462 of the beam contacts 420, 460. The pivot bar 512 has a different configuration on each side of the separation panel 502, which depends on the configuration of the beam contacts 420, 460. The pivot bar 512 need not be continuous along each side of the separation panel 502, but rather can have breaks or gaps.

In addition, the separation panel 502 has a reduced end portion 514 which is at the distal end and a part of the intermediate portion of the contact divider 500. The reduced end portion 514 has a reduced thickness with respect to the rest of the separation panel 502.

The beam contacts 420, 460 are assembled with the contact divider 500 in the same manner as for the embodiment of FIGS. 14-16, namely by compressing the beam contacts 420, 460 together, fitting the distal ends 426, 466 in the openings 510 of the divider nose 504, and then releasing the compression so that the distal ends 426, 466 come to rest against the preload stops 506. FIG. 17 shows the beam contacts 420, 460 fully assembled with the contact divider 500.

As further shown in FIG. 17, each beam contact 420, 460 has a proximal end 422, 462, an intermediate portion 424, 464, and a distal end 426, 466. The proximal end 422, 462 is the one closest to the insulative housing of the wafer 210, 250, and the distal end 426, 466 is at the opposite end of the contacts 420, 460. The intermediate portion 424, 464 is positioned between the proximal end 422, 462 and the distal end 426, 466. The intermediate portion 424, 464 has a flat section which is angled outward, away from the central contact divider 500, at an angle of about 3-5 degrees with the contact divider 500. Accordingly, this configuration forms an outward spring bias for the beam contacts 420, 460.

Each contact 420, 460 also has a first contact section 430, 470, a second contact section 440, 480, and an inwardly curved spring 450, 490. The first contact section 430, 470 is at the intermediate portion 424, 464 of the beam contact 420, 460 adjacent to the distal end 426, 466. The second contact section 440, 480 is at the intermediate portion 424, 464 closer to the proximal end 422, 462. And, the inwardly curved spring 450, 490 is at the proximal end 422, 462 of the beam contact 420, 460.

The first contact section 430, 470 is in the form of a curve that extends outward, away from the separation panel 502. A lossy or conductive coating or a metal contact pad 432, 472 is placed on the outside surface of the first contact section 430, 470. The first contact section 430, 470 has an outward most point which forms the first contact point 434, 474. The first contact point 434, 474 is also the outward most point on the beam contact 420, 460.

The second contact section 440, 480 is in the form of a metal conductive prong 442, 482 which is an integral part of the beam contact 420, 460 to form a single piece member. Alternatively, however, the prong 442, 482 can be a separate element which is attached to the intermediate portion 424, 464 of the beam contact 420, 460. The prong 442, 482 has a proximal end with a bend that projects the prong 442, 482 up and outward from the surface of the intermediate portion 424, 464. The bend leads into a flat section which runs substantially parallel to the flat section of the intermediate portion 424, 464. The flat section leads into a curved section which projects outwardly from the flat section of the prong 442, 482. The outward most point of the curved section forms a second contact point 444, 484 for the beam contacts 420, 460. The curved section is smaller than that of the first contact section 430, 470.

Finally, the distal end 426, 466 of the beam contact 420, 460 is flat, and has a reduced end portion 433, 473. The reduced end portion 433, 473 provides a better fit within the openings 510 of the divider nose 504, so that the beam contacts 420, 460 have a greater range of motion within the openings 510. The shape of the beam contact 420, 460 is configured so that the distal end 426, 466 is inward of the intermediate portion 424, 464 and approximately aligned with the inward curve 450, 490.

The operation of the invention will now be discussed with respect to FIGS. 17-19. Starting with FIG. 17, the contact divider 500 is fully inserted between the contacts 420, 460, so that the reduced portions 433, 473 of the distal ends 426, 466 are received in the openings 510 of the divider nose 504. In this starting position, the intermediate portion 424, 464 of each beam contact 422, 462, contacts the pivot bar 512. The pivot bar 512 pushes the intermediate portion 424, 464 outward. In addition, the beam contacts 420, 460 are outwardly biased. The pivot bar 512 and outward bias force each beam contact 420, 460 outward against the preload stop 506 of the divider nose 504. Also in this position, the first contact point 434, 474 extends outward farther than the second contact point 444, 484.

Figure 18:
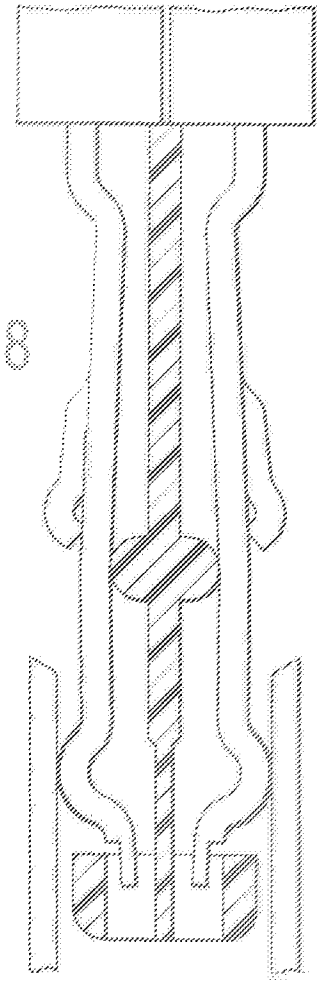
FIG. 18 is cross-section of the mating contacts of FIG. 12 during initial insertion between backplane blades.

Turning to FIG. 18, the assembled wafer pair 202 is inserted into the shroud 104. Here, the distal ends 426, 466 of the beam contacts 420, 460 have just entered the shroud 104, and are received in the channel 128 between the backplane blades 126. As the beam contacts 420, 460 slidably engage the backplane blades 126, the first contact points 434, 474 contact the backplane blades 126. Because the first contact section 430, 470 is curved, there is no stubbing of the contacts 420, 460 or the backplane blades 126. The backplane blades 126 cause the beam contacts 430, 470 to compress inwardly toward each other and against the outward bias of the beam contacts 420, 460.

In response to the inward compression of the beam contacts 420, 460, the distal ends 426, 466 move inward away from the preload stop 506. In addition, each intermediate portion 424, 464 rocks or pivots about the pivot bar 512. The pivot bar 512 shortens the length of the intermediate portion 424, 464 toward the distal end 426, 466 of the contact 420, 460, which increases its spring rate. This pivoting action, in turn, deflects the curved spring 450, 490 and bows the upper part of the intermediate portion 424, 464 outward. It also forces the second contact point 444, 484 outward, so that the second contact point 444, 484 is further outward than the first contact point 430, 470.

Figure 19:
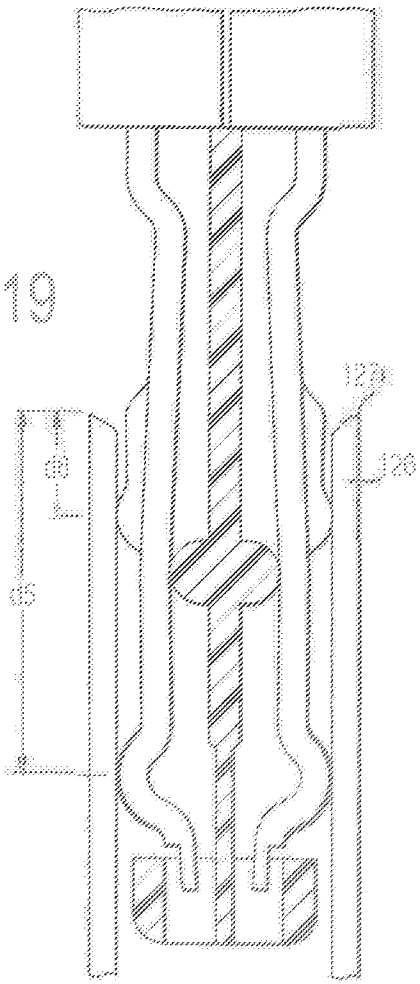
FIG. 19 is a cross-section of the mating contacts of FIGS. 12 and 13 during final insertion between the backplane blades, with the mating contacts fully mated with the backplane blades.

Turning to FIG. 19, the user continues to press the wafer pair 202 into the shroud 104, and the second contact points 444, 484 slidably engage the respective backplane blades 126. The second contact sections 440, 480, which do not have a preload force, are depressed inward by the backplane blades 126. That also forces the beam contacts 420, 460 inwardly, which creates a responsive back force about the pivot bar 512. That relieves some of the force on the spring curve 450, 490, and pushes the first contact sections 430, 470 outward against the backplane blades 126. That forms a stronger contact between the first contact sections 430, 470 and the backplane blades 126 by virtue of being pushed outwardly against the backplane blades 126 about the pivot bar 606. It also normalizes the force of both the first contact section 430, 470 and the second contact section 440, 480, which are now equalized.

As with FIGS. 14-16, the embodiment of FIGS. 17-19 minimizes the stub length of the connections between the beam contacts 420, 460 and the backplane blades 126. More specifically, the stub distance d6 from the second contact points 444, 484 to the leading end 127 of the backplane blades 126 is significantly reduced, and is especially much shorter than the stub distance d5 between the first contact points 432, 472 and the end 127 of the backplane blades 126. This is particularly important with high signal frequencies, which may cause a larger stub length to behave like an antenna. The addition of the second contact points 444, 484 and the resulting shorter stub distance d6 reduces the likelihood of antenna behavior, thus reducing cross-talk.

In summary, the invention provides constant electrical contact between mating connectors while reducing the initial insertion force. After insertion, the connector maintains a high normal connection force of the first and second contact points 32, 33 (FIG. 5), 232, 272, 242, 282 (FIG. 16) and 432, 472, 444, 484 (FIG. 16) against the backplane beam contacts 21 or the backplane blades 126, furthering continued constant electrical contact. In addition to the improved reliable electrical contact, stubbing (which can cause an antenna effect under high frequency conditions) is significantly reduced. The invention requires a low initial insertion force for the daughtercard beam contacts 20, 220, 260, 420, 460, and provides a high normal force when fully mated, which is very reliable. The invention also minimizes the electrical concerns due to contact over travel.

It should be noted that, in accordance with the preferred embodiment, two wafers 210, 250 are provided, each having a row of mating contacts 20, 220, 260, 420, 460. This provides an opposing force on each opposing side or surface of the contact divider 90, 300, 500 which balances the force on the contact divider 90, 300, 500. However, the invention can be utilized with only a single wafer and a single row of mating contacts extending on only one surface of the contact divider 90, 300, 500, so long as the contact divider 90, 300, 500 is sufficiently affixed or made integral to the wafer housing to counteract the forces on the contact divider 90, 300, 500.

In addition, one skilled in the art will appreciate that the contact sections in the embodiments of FIG. 5. FIG. 14, and FIG. 17 can be interchanged with one another. For instance, the prong 442 can be utilized for either of the first contact section 230, 270 and/or the second contact section 240, 280. Or, the curved contact section 240 can be utilized for the second contact section 440. And, the mating contacts 20,

220, 260 and 420, 460 need not be symmetrical or have similar shapes. For instance, the prong 442 can be utilized for the first contact section 230, but not for the second contact section 270, which can remain curved.

Figure 21:
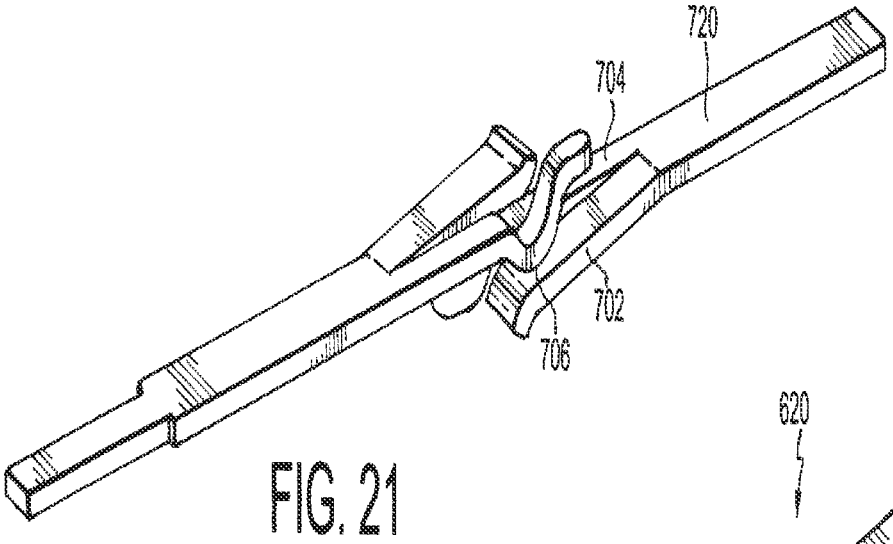
FIG. 21 is a perspective view of another embodiment of the invention.

Turning to FIG. 21, another embodiment of the invention is shown. Here, a split is formed at the distal end of the beam 720 that can extend into the intermediate portion of the beam. The split defines a first finger 702 and a second finger 704. The first finger 702 forms a flat ramp that is angled outward (down for the beam 720 on the right side of the embodiment and up for the beam 720 on the left side of the embodiment) at with respect to the second finger and with respect to the body of the beam 720, where the split is formed with the body of the beam 720. The second finger 704 has a flat portion and a curved portion that forms a curved contact section 706. By providing a sloped ramp finger 702, the second finger 704 of a mating beam can more easily be slidably received without stubbing, as shown. The extreme distal end of the ramp is slightly curved outward to further avoid stubbing.

Figure 22:
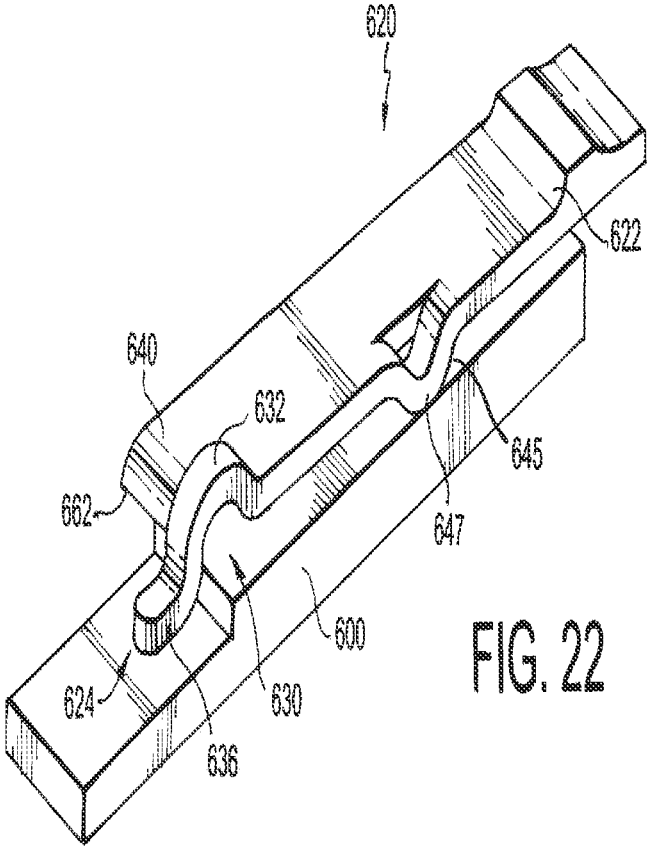
FIG. 22 is a perspective view of another embodiment of the invention having the pivot member on the beam.

Referring now to FIG. 22, another non-limiting illustrative embodiment of the invention is shown. Here, a daughtercard beam contact 620 is shown adjacent a divider panel 600. The panel 600 is flat and does not have a pivot bar (which is used, for instance, in FIGS. 5-6). Instead, the beam contact 620 has a body portion 622 that is flat and elongated, with an outward-facing top surface and an opposite inward-facing top surface that faces the divider 600. A projection or curved portion 645 is provided along one of the elongated sides 624 of the body 622. The curved portion 645 projects outward (and downward in the embodiment shown) from the inward-facing top surface of the body 622 toward the divider 600. The curved portion 645 is a slight bend that forms a pivot point 647 which can contact the divider 600, as shown.

The curved portion 645 is at the intermediate portion of the beam 620, approximately midway along the longitudinal length of the beam body 622. It is slightly elongated with its longitudinal axis parallel to the longitudinal axis of the beam 620. It extends only partway (about one-fourth) across the width of the beam body 622 so that it does not affect the overall integrity, flexibility and performance of the beam. The curved portion 645 is formed integral with the beam 620 and connects with the beam at two locations so that the curved portion 645 is sufficiently rigid. In this way, it can maintain an appropriate distance between the beam 620 and the divider 600 when under pressure during insertion into the backplane connector 100. It should be apparent, however, that the curved portion 645 can have other configurations, shapes and sizes. For instance, though shown integral with the beam body 622, it can be separate from the beam and attached to the inward-facing top surface of the beam body 622 such as by an adhesive. And, the curved portion 645 can extend the entire width of the beam body 622, or it can be placed at the middle of the width of the beam, or at the side opposite the contact section 630. In addition, the curved portion 645 need not be elongated.

The curved portion 645 can be formed in any suitable manner. For instance, a slit can be cut from the beam 620, then the cut portion can be curved outward using a curved punch and anvil that slices the metal and stretches it onto the anvil. The curved portion 645 is about 0.006 inches in thickness, and the curved portion 645 extends out from the beam face by up to about the same distance of 0.006 inches.

The beam 620 also has a contact section 630 at the very distal end of the beam 620. The contact section 630 is curved outward from the outward-facing top surface of the beam body 622, in an opposite direction than the curved portion 645. The contact section 630 can have a similar configuration to the earlier embodiments of FIGS. 1-19, but here is shown having a similar configuration to FIG. 11 except that the tab 636 has the same width as the contact point 632. The contact section 630 is formed at a split along the width of the distal end of the beam 620, forming a finger 662 having a flat section 640 with a downward sloped ramp on one side and the contact section 630 at the other side.

In addition, the contact section 630 can have substantially the same width as the curved portion 645. The curved portion 645 is preferably located at the same longitudinal side 624 of the beam body 622 as the contact section 630 and is the same width or narrower than the contact section 630 (and no greater than one-half the width of the beam body 622), as shown. In this way, the contact section 630 of the other mating beam has a continuous flat surface to slidably ride on as the beams are engaged. However, the contact section 630 is formed integral with the beam body 622, so that the contact section 630 is strong and resilient, though also flexible.

In operation, the curved portion 645 provides a pivot at the beam 620 instead of at the divider 600, as the daughtercard connector 200 is mated with and slidably inserted into the backplane connector 100. This eliminates any variables due to having the pivot on the divider and provides a more precise pivot point. The backplane contacts and panel inserts 106 are configured in a similar manner, so that the operation proceeds as discussed with respect to FIGS. 1-19 above.

The foregoing description and drawings should be considered as illustrative only of the principles of the invention. The invention may be configured in a variety of shapes and sizes and is not intended to be limited by the preferred embodiment. For instance, the contact sections can be more pointed or angled, rather than rounded. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. An electrical connector, comprising:

an insulative housing;

a divider panel extending outward with respect to the insulative housing; and a contact beam extending outward from the insulative housing and including a pivot member and a contact section, wherein:

the pivot member has a curved portion projecting towards the divider panel and extending partway across a width of the contact beam;

the contact section is curved and projects away from the divider panel and is at a distal end of the contact beam;

a first finger is formed at one side of a split at the distal end of the contact beam, and a second finger is formed at the other side of the split;

the first finger has a flat section with a sloped ramp; and the second finger includes the contact section and a tab.

2. The electrical connector of claim 1, wherein the pivot member is formed at an intermediate portion of the contact beam.

3. The electrical connector of claim 1, wherein the curved portion of the pivot member is elongated with a longitudinal axis parallel to a longitudinal axis of the contact beam.

4. The electrical connector of claim 1, wherein the curved portion of the pivot member is located at the same longitudinal side of the contact beam as the contact section.

5. The electrical connector of claim 1, wherein the tab extends beyond the first finger and engages with an insulative nose disposed at an end of the divider panel.

6. An electrical connector, comprising:

an insulative housing;

a divider panel extending outward with respect to the insulative housing; and a contact beam extending outward from the insulative housing and including a pivot member and a contact section, wherein:

the pivot member has a curved portion projecting towards the divider panel and extending partway across a width of the contact beam;

the contact section is curved and projects away from the divider panel and is at a distal end of the contact beam;

a first finger is formed at one side of a split at the distal end of the contact beam, and a second finger is formed at the other side of the split;

the first finger includes a flat section with a sloped ramp and a tab; and the second finger includes the contact section.

7. The electrical connector of claim 6, wherein the tab extends beyond the second finger and engages with an insulative nose disposed at an end of the divider panel.

8. An electrical interconnection assembly, comprising:

a first electrical connector including:

a first insulative housing;

a first divider panel extending outward with respect to the first insulative housing; and a first contact beam extending outward from the first insulative housing and including a first pivot member and a first contact section, wherein:

the first pivot member has a first curved portion projecting towards the first divider panel and extending partway across a width of the first contact beam; and a first contact section is curved and projects away from the first divider panel and is at a distal end of the first contact beam; and a second electrical connector including:

a second divider panel extending outward with respect to a second insulative housing; and a second contact beam extending outward from the second insulative housing and including a second pivot member and a second contact section, wherein the second pivot member has a second curved portion projecting towards the second divider panel and extending partway across a width of the second contact beam;

wherein as the first contact beam slidably engages the second contact beam, the first contact section contacts the second contact beam, and the first contact beam pivots about the first pivot member.

9. The electrical connector of claim 8, wherein as the first contact beam slidably engages the second contact beam, the second contact section contacts the first contact beam, and the second contact beam pivots about the second pivot member.

10. The electrical connector of claim 8, wherein the first curved portion of the first pivot member is elongated with a longitudinal axis parallel to a longitudinal axis of the first contact beam.

11. The electrical connector of claim 8, wherein:

the first curved portion of the first pivot member is located at the same longitudinal side of the first contact beam as the first contact section;

the second curved portion of the second pivot member is located at the same longitudinal side of the second contact beam as the second contact section; and as the first contact beam slidably engages the second contact beam, the first contact section and the second curved portion are at different longitudinal sides of the first contact beam.

12. The electrical connector of claim 8, wherein:

a width of the first curved portion of the first pivot member is equal to or narrower than a width of the first contact section; and a width of the second curved portion of the second pivot member is equal to or narrower than a width of the second contact section.

13. The electrical connector of claim 8, wherein:

a first finger of the first contact beam is formed at one side of a split at the distal end of the first contact beam, and a second finger of the first contact beam is formed at the other side of the split;

the first finger of the first contact beam has a flat section with a sloped ramp; and the second finger of the first contact beam includes the first contact section and a tab.

14. The electrical connector of claim 13, wherein the tab extends beyond the first finger and engages with an insulative nose disposed at an end of the first divider panel.

15. The electrical connector of claim 8, wherein:

a first finger of the first contact beam is formed at one side of a split at the distal end of the first contact beam, and a second finger of the first contact beam is formed at the other side of the split;

the first finger includes a flat section with a sloped ramp and a tab; and the second finger includes the first contact section.

16. The electrical connector of claim 15, wherein the tab extends beyond the second finger and engages with an insulative nose disposed at an end of the first divider panel.

* * * * *